United States Patent [19]

Sixsmith

[11] Patent Number: 4,599,825

[45] Date of Patent: Jul. 15, 1986

[54] INTERIOR STORM WINDOW

[76] Inventor: Thomas Sixsmith, 22016 Buenaventura St., Woodland Hills, Calif. 91364

[21] Appl. No.: 765,584

[22] Filed: Aug. 14, 1985

[51] Int. Cl.[4] ..... E06B 7/18

[52] U.S. Cl. ..... 49/466; 49/61; 49/488; 52/202

[58] Field of Search ..... 49/466, 465, 463, 460, 49/62, 61, 489, 488; 160/354, 369; 52/202, 203

[56] References Cited

U.S. PATENT DOCUMENTS

| | | | |
|---|---|---|---|
| 2,612,947 | 10/1952 | Jenks | 160/354 X |
| 2,718,677 | 9/1955 | Cornell | 49/489 X |
| 2,933,781 | 4/1960 | Cornell | 49/489 X |
| 2,935,769 | 5/1960 | Lutes | 52/202 |
| 2,935,771 | 5/1960 | Hatcher, Jr. | 49/489 X |
| 3,276,167 | 10/1966 | Bus et al. | 49/489 X |
| 4,160,348 | 7/1979 | Chapman et al. | 160/354 X |
| 4,351,868 | 9/1982 | Otani | 49/460 X |
| 4,486,990 | 12/1984 | Baugh | 52/202 |

*Primary Examiner*—Philip C. Kannan

*Attorney, Agent, or Firm*—William J. Ruano

[57] ABSTRACT

An interior storm window comprising an adjustable seal extending about the perimeter of the storm window and being in the form of a strip of extruded, flexible plastic material having an inverted "U" shape with a sealing bead extending upwardly from the bight of the "U" and spaced arrow-shaped portions extending downwardly from each side of the bead. The end portions extend into correspondingly shaped openings in an extruded frame of rigid plastic material which surrounds a pair of glazing sheets whose outer perimeters extend into and are firmly supported by the frame.

8 Claims, 3 Drawing Figures

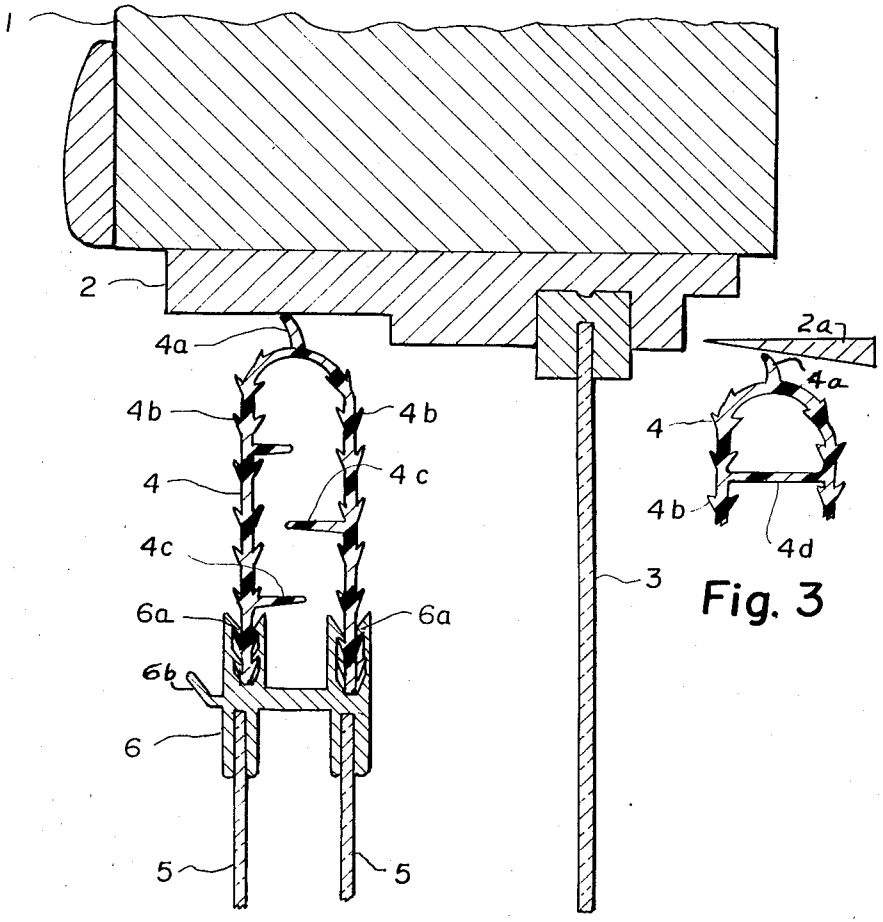
Fig. 2
Fig. 3
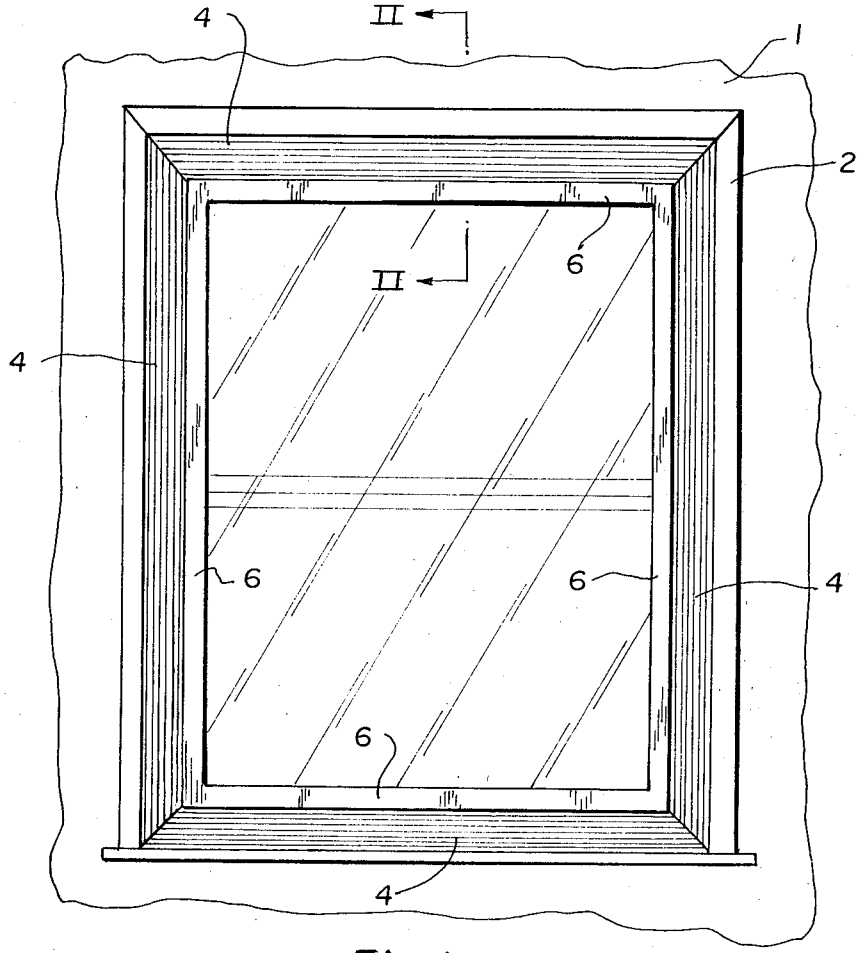
Fig. 1

INTERIOR STORM WINDOW

This invention relates to an interior storm window, particularly one which is adjustable to varying sizes of the opening of a window frame.

An outstanding disadvantage of existing interior storm windows is that they are not adjustable in length and width over a sufficiently large range as to fit varying sizes of window frames.

SUMMARY OF THE INVENTION

An object of the present invention is to provide a novel adjustable interior window frame which overcomes the abovenamed disadvantages of present window frames, by providing a wide range of adjustment of the order of over 5" in height and width with respect to the storm window which it surrounds to limit the number of sizes of storm windows which have to be carried in inventory.

Other objects and advantages of the invention will become apparent from a study of the following description taken with the accompanying drawing.

BRIEF DESCRIPTION OF DRAWING

FIG. 1 is an elevational view of an adjustable interior storm window embodying invention;

FIG. 2 is a cross-sectional view taken along line II—II of FIG. 1; and FIG. 3 is a similar view of a modification.

Referring to FIGS. 1 and 2 of the drawing, numeral 1 denotes an opening in the vertical wall of a house or other structure which surrounds a window frame 2 having an existing primary window 3.

DETAILED DESCRIPTION

The present invention relates to the structure of an interior storm window and, more specifically, to an adjustable seal or sealing edge 4 in the form of a sheet which extends about the perimeter. acrylic glazing 5,5 has an outer perimeter which fits into the slots contained in the bottom of an extruded frame 6 of plastic material, such as rigid polyvinylchloride, having a gripping edge **6*b*** to pull the window out.

The adjustable seal or sealing edge 4 is of inverted "U" shape in cross-section and has projecting centrally and upwardly from the bight of the inverted "U", a flexible bead **4*a* to form a tight seal with the inner surface of the window frame 2. On each side of the bead 4*a*, there are a plurality of spaced arrow heads, in cross-section, extending downwardly toward the receptacle portion of frame 6** so as to interlock therewith correspondingly shaped arrow head slots, since the arrows can move downwardly, but not upwardly, relative to such rceptacle portion.

The width and length of the storm window may be varied about 5" or less simply by cutting off the lower end portions of the adjusting sealing edge 4 by a number of arrow heads.

The interior space defined by the adjustable sealing edge 4 may be filled with foam as a core or any other material to give greater rigidity or ribbed at **4*c* or webbed at 4*d* (FIG. 3**).

While the interior surface of the window frame 2 is shown as horizontal, wedge addition **2*a* may be tapered downwardly about 20° in the direction of the primary window 3 throughout the entire perimeter of the frame 2, if desired, to provide even a tighter fit with portion 4*a*, as shown in FIG. 3**.

In operation, a customer would measure the window opening to determine the correct size window panel needed. After checking the size of the opening, this would indicate how much the sealing edge 4 has to be trimmed off by cutting off, with scissors, one more notch or arrow head than what is required to give a tight fit and to provide the necessary spring or friction to hold the panel securely within the window frame. For closer adjustment, serrations may be used instead of spaced arrow heads. Bead **4*a*** will fill small gaps that may occur along the window frame and may be somewhat more flexible than the notches themselves. The adjustable sealing edge may be white or of any other color by painting. The weight is minimized by using thin acrylic glazing of ⅛" to 1/10" thick.

The invention provides a more durable sealing edge which increases the life of the product many years. It would be clear with less distortion, making it more attractive to customers. The acrylic sheeting would be stronger compared with the flexible vinyl sheeting, adding to further attraction. The construction is particularly suitable for the "do-it-yourself" person. The construction may be made with lower manufacturing and assembly costs. The same panel may be reused for a similar sized window. This assembly would make it possible to make repairs or to clean between the two sheets of acrylic glazing, if necessary.

Thus it will be seen that I have provided an interior storm window that can be adjusted in length and width over a wide range, within 5", in either dimension and which can be easily installed by the "do-it-yourself" individual, also which can be easily varied in size, and which can be inexpensively manufactured and packaged.

While I have illustrated and described a single specific embodiment of my invention, it will be understood that this is by way of illustration only and that various changes and modifications may be contemplated in my invention within the scope of the following claims.

I claim:

1. In combination with a window frame, an interior storm window having a rigid frame extending about the perimeter of the window, the outer edge of said frame having a pair of parallel slots, a sealing edge of flexible plastic sheet material of variable width having an inverted elongated "U" cross-section with one-way acting projections extending downwardly on the outer surface of each leg of the inverted "U", said slots being correspondingly shaped to form a one-way locking fit with the lower extremeties of said inverted elongated "U" sealing edge, whereby the width of said sealing edge may be varied by cutting off said lower extremities of said sealing edge and substituting the remaining lowermost projections for locking engagement in said slots.

2. The combination as recited in claim 1 wherein said projections are in the form of spaced arrow heads which point toward said slots and which are located outwardly and inwardly of said slots.

3. The combination recited in claim 1 wherein said projections are in the form of serrations which point toward said slot means.

4. The combination recited in claim 1 wherein a sealing bead integrally extends upwardly from the center of the bight portion of said inverted elongated "U" to form a seal with said interior surface of said window frame, and which is the sole means of securing said window within said receiving window frame.

5. The combination recited in claim 4 wherein said window frame is tapered downwardly toward the window at an angle of about 20° to form a wedging fit.

6. The combination recited in claim 4 wherein spaced transverse rib means are provided inside said sealing edge to prevent collapse.

7. The combination recited in claim 6 wherein said rib means comprises a plurality of integral horizontal projections extending alternately from both inner wall surfaces of said sealing edge.

8. The combination recited in claim 6 wherein said window frame is tapered downwardly toward the window at an angle of about 20° to form a wedging fit.

* * * * *